US010004999B2

(12) United States Patent
Aarstad

(10) Patent No.: US 10,004,999 B2
(45) Date of Patent: Jun. 26, 2018

(54) CONNECTABLE ELEMENT FOR CREATING CHAINS AND SPATIAL STRUCTURES

(71) Applicant: Luna Loop AS, Egersund (NO)

(72) Inventor: Anne Marit Aarstad, Egersund (NO)

(73) Assignee: Luna Loop AS, Egersund (NO)

( * ) Notice: Subject to any disclaimer, the term of this patent is extended or adjusted under 35 U.S.C. 154(b) by 0 days. days.

(21) Appl. No.: 15/038,613

(22) PCT Filed: Nov. 27, 2014

(86) PCT No.: PCT/NO2014/050221
§ 371 (c)(1),
(2) Date: May 23, 2016

(87) PCT Pub. No.: WO2015/080594
PCT Pub. Date: Jun. 4, 2015

(65) Prior Publication Data

US 2016/0288010 A1 Oct. 6, 2016

(30) Foreign Application Priority Data

Nov. 28, 2013 (NO) ..... 20131572

(51) Int. Cl.
*A63H 33/04* (2006.01)
*A63H 33/10* (2006.01)

(52) U.S. Cl.
CPC ..... *A63H 33/101* (2013.01)

(58) Field of Classification Search
CPC .... A63H 33/062; A63H 33/042; A63H 33/04; A44C 11/00; A44C 11/002; A44C 11/007; F16G 13/14; F16G 15/02
See application file for complete search history.

(56) References Cited

U.S. PATENT DOCUMENTS 2,119,921 A * 6/1938 Levy ..... A63H 33/062 446/116
2,775,093 A * 12/1956 Kundert ..... A44C 5/102 446/120
2,791,868 A * 5/1957 Viken ..... A63H 33/062 428/11

(Continued)

FOREIGN PATENT DOCUMENTS

CN 1062096 6/1992
CN 101491737 7/2009

(Continued)

OTHER PUBLICATIONS

Norwegian Search Report, Application No. 20131572, dated Jun. 3, 2014.

(Continued)

*Primary Examiner* — John E Simms, Jr.
*Assistant Examiner* — Urszula M Cegielnik
(74) *Attorney, Agent, or Firm* — Andus Intellectual Property Law, LLP

(57) ABSTRACT

A connectable element comprising a center piece and a connecting piece. The center piece includes a connecting portion and at least one encircling groove The connecting piece includes an end portion and an eye in a portion. The end portion of the connecting piece is attached to the connecting portion of the center piece. The eye complementarily fits the encircling groove of an adjacent center piece.

18 Claims, 12 Drawing Sheets

(56) References Cited

U.S. PATENT DOCUMENTS 3,315,376 A * 4/1967 Nielsen ..... G09B 1/40 434/160
3,457,658 A * 7/1969 Smoot ..... G09B 23/26 434/277
3,670,449 A * 6/1972 Lemkin ..... A63H 33/088 446/102
3,699,709 A * 10/1972 Schmidt ..... A63H 33/067 206/338
4,509,930 A * 4/1985 Schweigert ..... A63H 33/065 220/4.29
4,581,793 A * 4/1986 Micklitz ..... A63H 33/102 24/297
4,685,892 A * 8/1987 Gould ..... A63H 33/062 446/109
4,731,041 A * 3/1988 Ziegler ..... A63H 33/065 446/102
4,874,341 A * 10/1989 Ziegler ..... A63H 33/08 446/104
5,094,643 A * 3/1992 Bolli ..... A63H 33/04 403/348
5,103,755 A * 4/1992 Garrett ..... B66C 1/12 116/200
6,135,851 A 10/2000 Drake et al.
6,508,690 B2 * 1/2003 Axelrad ..... A63H 33/062 446/108
7,798,884 B2 * 9/2010 Barcelo ..... A63H 33/101 446/120
8,382,548 B2 * 2/2013 Maggiore ..... A63H 33/062 446/120
2003/0077109 A1 4/2003 Chen
2006/0016218 A1 1/2006 Shapiro et al.

FOREIGN PATENT DOCUMENTS

GB 814329 6/1959
JP S52-23298 2/1977
WO 2006/083084 8/2006

OTHER PUBLICATIONS

PCT Written Opinion, PCT/NO2014/050221, dated Oct. 3, 2015.
PCT Search Report, PCT/NO2014/050221, dated Oct. 3, 2015.

* cited by examiner

Fig. 4A
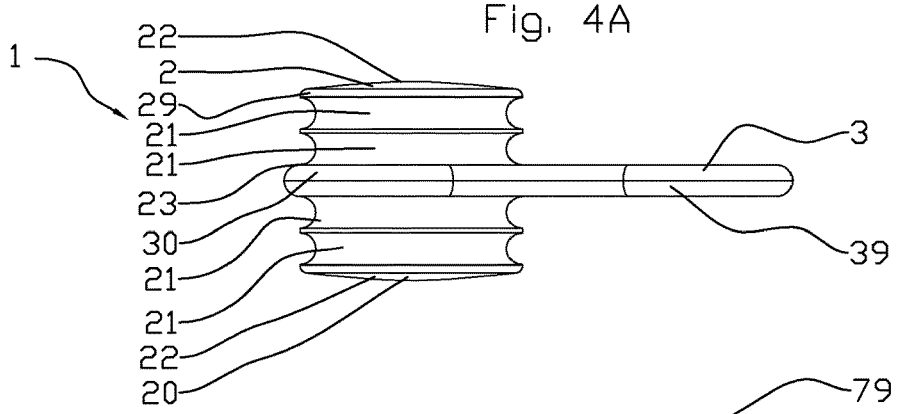
Fig. 4B
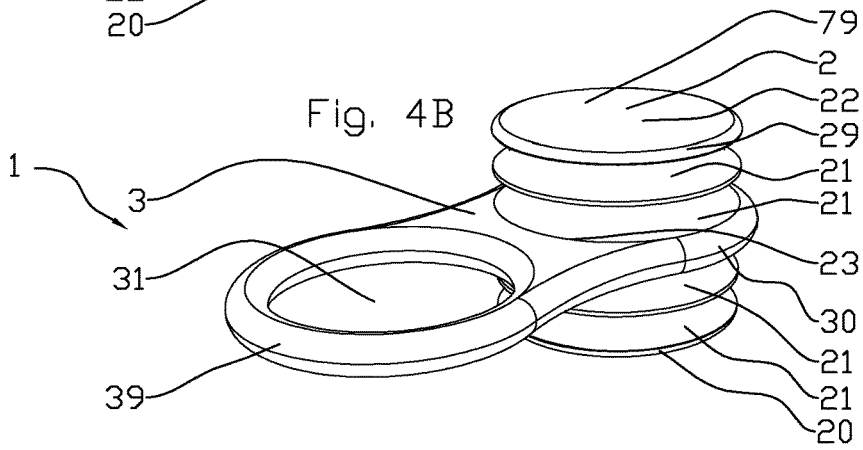
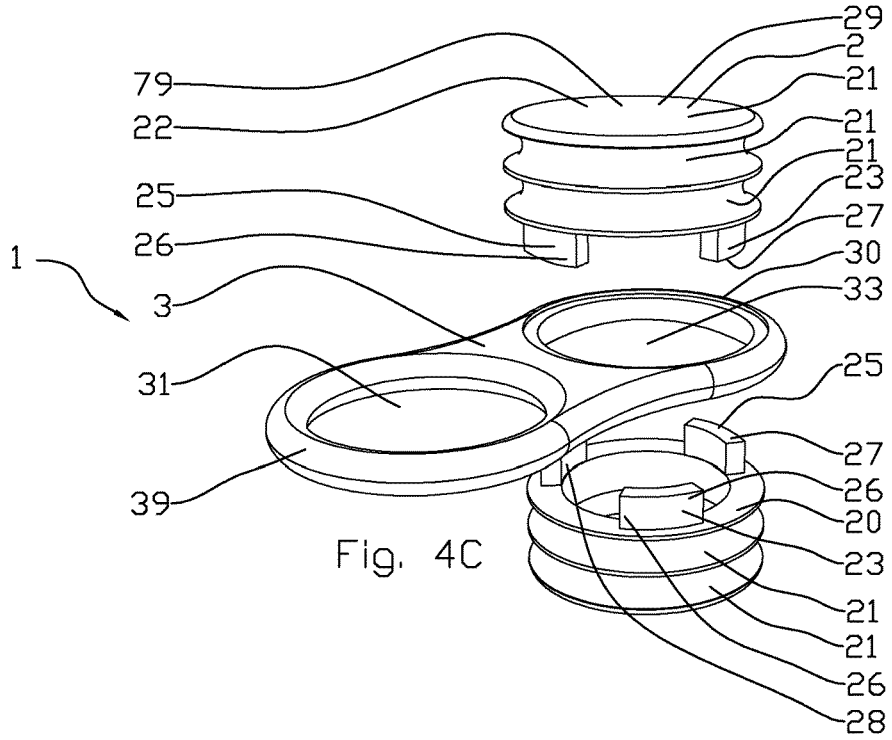
Fig. 4C

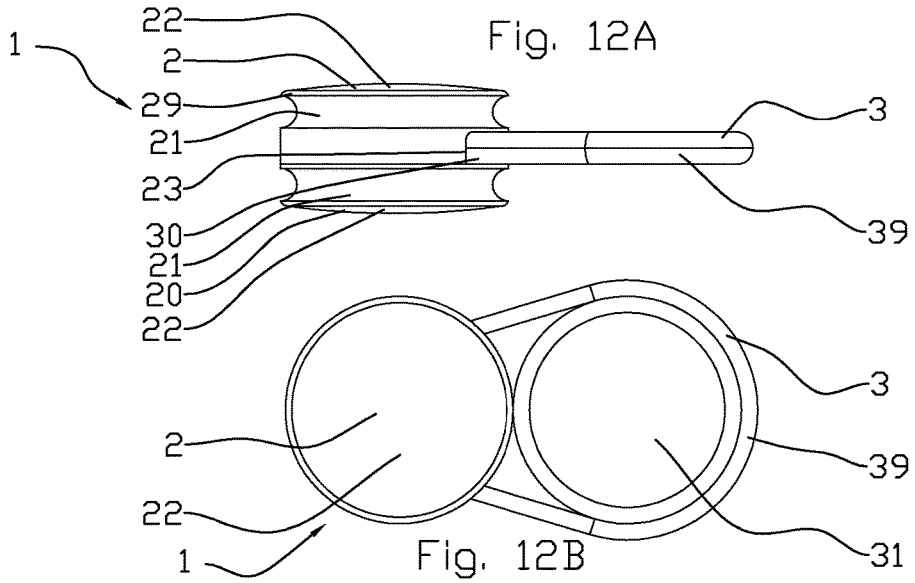
Fig. 12A
Fig. 12B
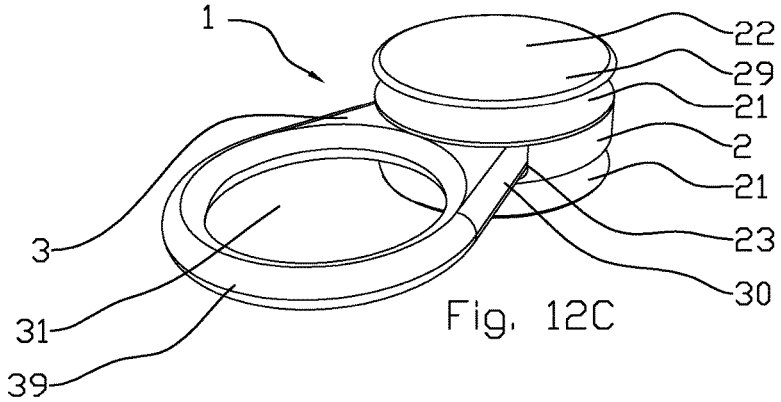
Fig. 12C
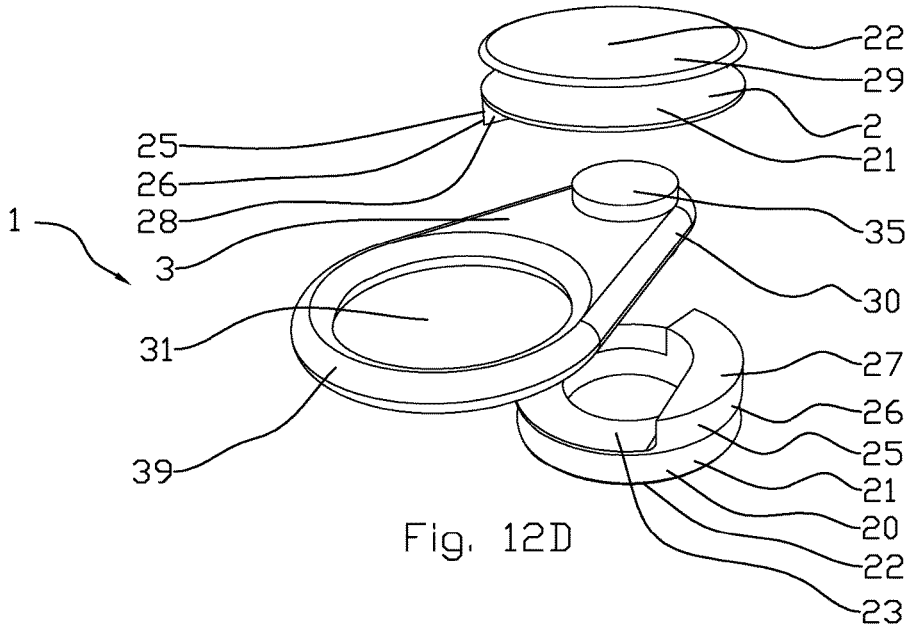
Fig. 12D

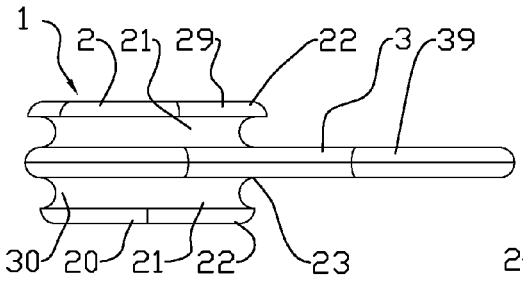
Fig. 13A
Fig. 13B
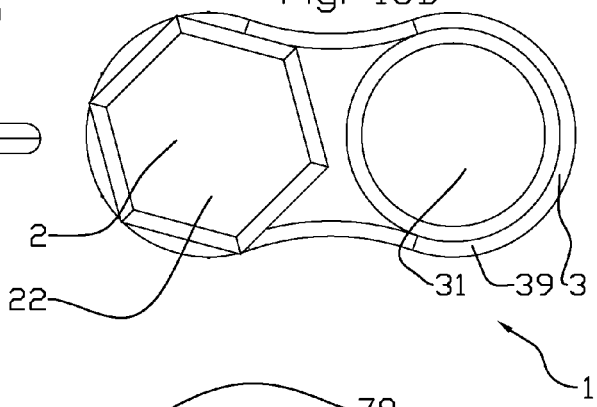
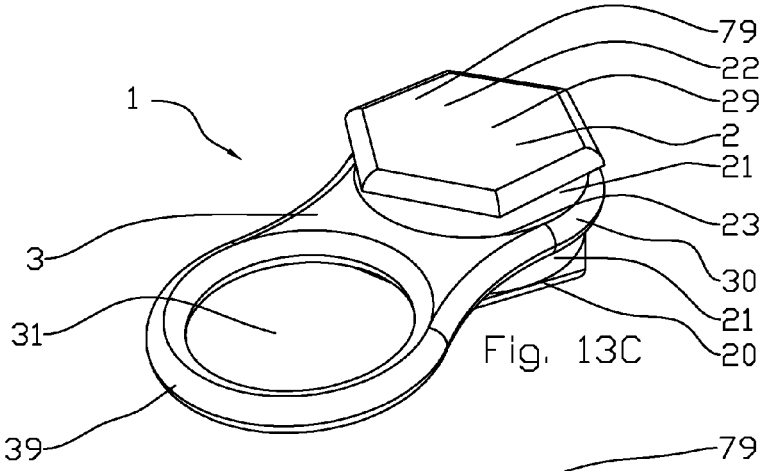
Fig. 13C
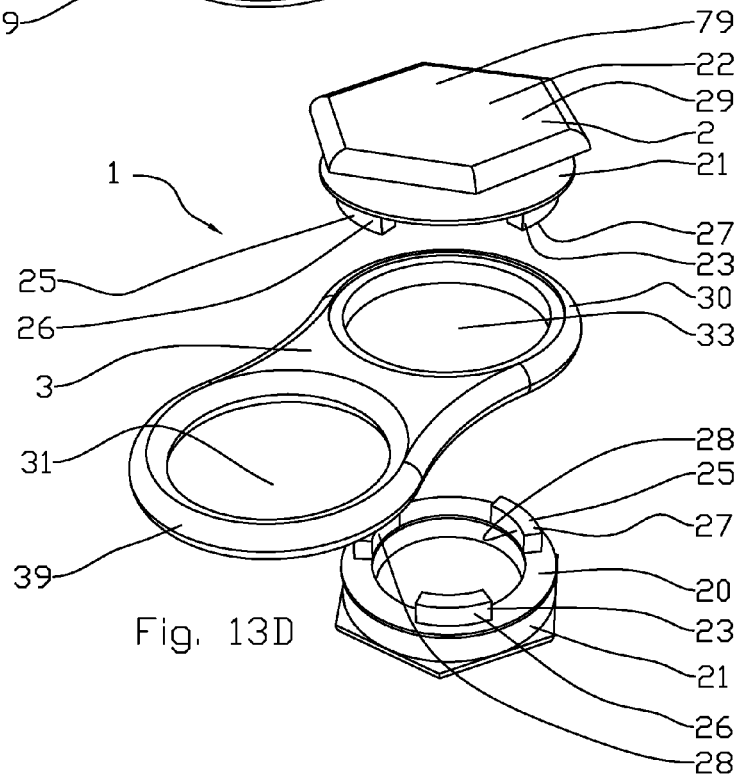
Fig. 13D

CONNECTABLE ELEMENT FOR CREATING CHAINS AND SPATIAL STRUCTURES

CROSS-REFERENCE TO RELATED APPLICATIONS

This application is the U.S. national stage application of International Application PCT/NO2014/050221, filed Nov. 27, 2014, which international application was published on Jun. 5, 2015, as International Publication WO 2015/080594 in the English language. The international application is incorporated herein by reference, in entirety. The international application claims priority to Norwegian Patent Application No. 20131572, filed Nov. 28, 2013, which is incorporated herein by reference, in entirety.

FIELD

The invention relates to a connectable element which can be used as a toy or a pedagogic tool. Several connectable elements may be connected into chains. To one first chain, a second chain may be connected, having a longitudinal direction that is different from the longitudinal direction of the first chain.

BACKGROUND

The patent publication WO 2006/083084 discloses a puzzle of pieces that are put together into chains. The pieces may have a polygonal shape like a triangle, rectangle, hexagon and so on. The pieces comprise an upper half and a lower half which may be joined together and separated. Two adjacent pieces are held together by a rigid connecting link. A first connecting link is threaded onto a center pin projecting upwards in a lower piece half. A disc of a soft material is threaded onto the center pin. If desirable, a second connecting link may be threaded onto the center pin before the upper piece half is threaded onto the center pin to lock the connecting links by being pressed into position. The disc of the soft material holds the connecting links, so that the assembly does not rattle and appear loose.

The patent publication WO 2006/083084 thus discloses a puzzle in which each piece comprises at least four different parts. For small children it is difficult to put the pieces together. The puzzle contains small parts. The puzzle also has the drawback of pieces that lack either the bottom part, the top part or the connecting link being unusable. The geometric possibilities of the puzzle are limited to the shape of the piece. Triangular pieces cannot be combined with, for example, rectangular pieces or hexagonal pieces as the pieces are laid edge to edge. The rigid connecting link allows the puzzle to be laid on a flat surface only.

SUMMARY

The invention has for its object to remedy or reduce at least one of the drawbacks of the prior art or at least provide a useful alternative to the prior art.

The object is achieved through features which are specified in the description below and in the claims that follow.

The invention relates to a connectable element that comprises a center piece and a connecting piece, the center piece including a connecting portion and at least one encircling groove; and the connecting piece including an end portion and an eye in a portion; the end portion of the connecting piece being attached to the connecting portion of the center piece, and the eye complementarily fitting the encircling groove of an adjacent center piece.

Two adjacent center pieces may have the same dimension, and the connectable elements may be uniform and of the same size. Alternatively, the adjacent center pieces may be of different dimensions and the connecting pieces may have different diameters in their respective eyes for them to complementarily fit the encircling groove of the adjacent center piece.

The connecting piece may comprise an elastic material.

The end portion of the connecting piece may be attached internally in the center piece. The piece may be provided with a pin internally, and the end portion of the connecting piece may be provided with an eye that is complementary to the pin. The end portion of the connecting piece may be provided with a thickening that fits internally in the center piece. The end portion of the connecting piece may be provided with an eye that surrounds the connecting portion of the center piece.

The center piece may comprise an upper half and a lower half, and at least one of the halves may be provided with at least one projecting element for joining the two halves. The element may consist of a pin. The element may consist of welding lugs.

The center piece may include at least one encircling groove on each side of the connecting portion. The encircling groove may be of a circular shape.

The end portion of the center piece may be of a circular shape. The end portion of the center piece may be formed as a polygon. The end portion of the center piece may include an end face, and the end face may be provided with information.

BRIEF DESCRIPTION OF THE DRAWINGS

In what follows, examples of preferred embodiments are described, which are visualized in the accompanying drawings, in which:

FIGS. 4A-C show the invention in a fourth embodiment; A: in a side view, B: in a perspective view and C: in an exploded view;

FIGS. 12A-D show the invention in a ninth embodiment; A: in a side view, B: in a top view, C: in a perspective view and D: in an exploded view; and FIGS. 13A-D show the invention in a tenth embodiment; A: in a side view, B: in a top view, C: in a perspective view and D: in an exploded view.

DETAILED DESCRIPTION OF THE DRAWINGS

Figure 1A:
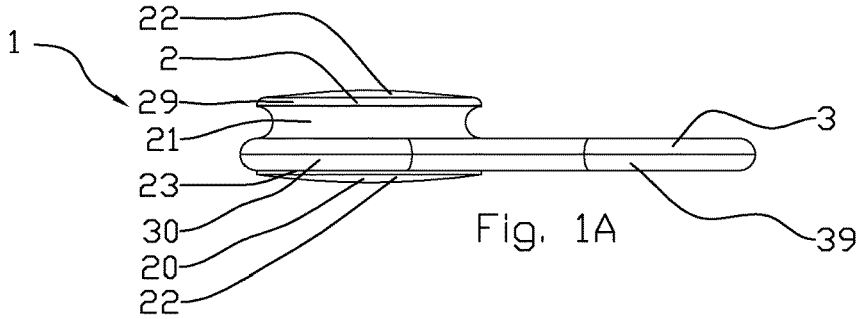
FIGS. 1A-D show the invention in a first embodiment; A: in a side view, B: in a top view of a connecting piece, C: in a perspective view and D: in an exploded view.
Figure 1B:
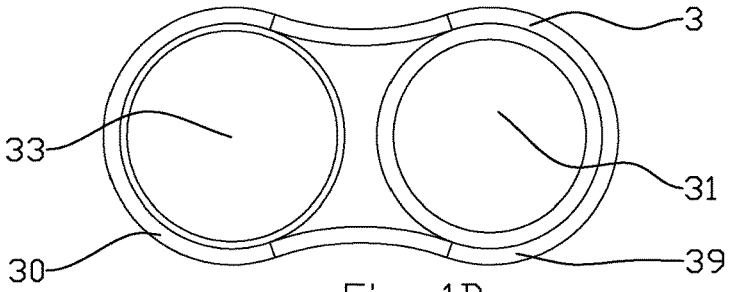
Figure 1C:
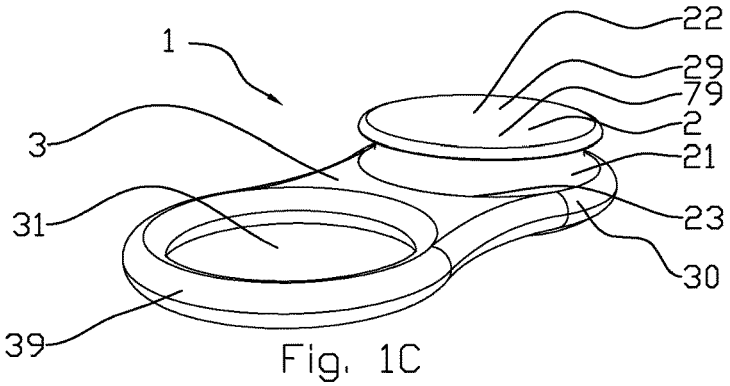
Figure 1D:
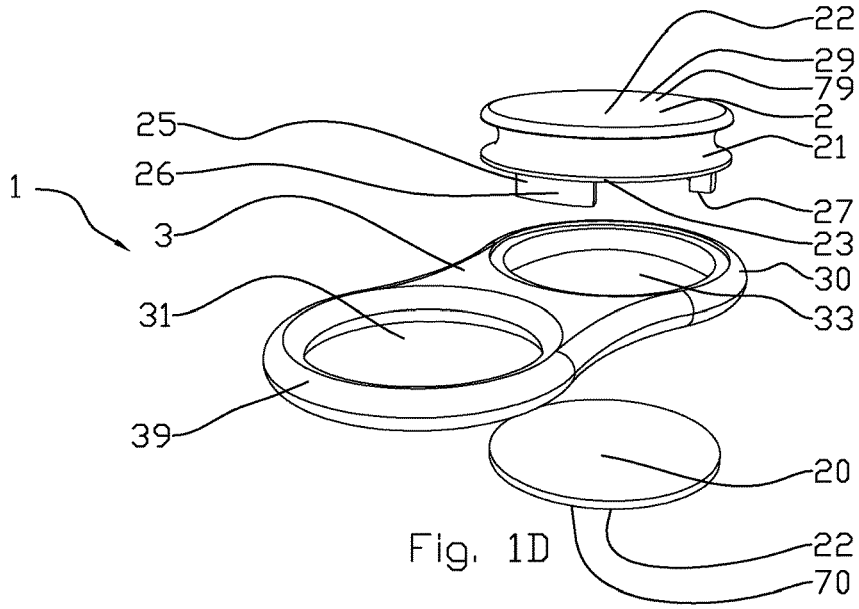
Figure 2A:
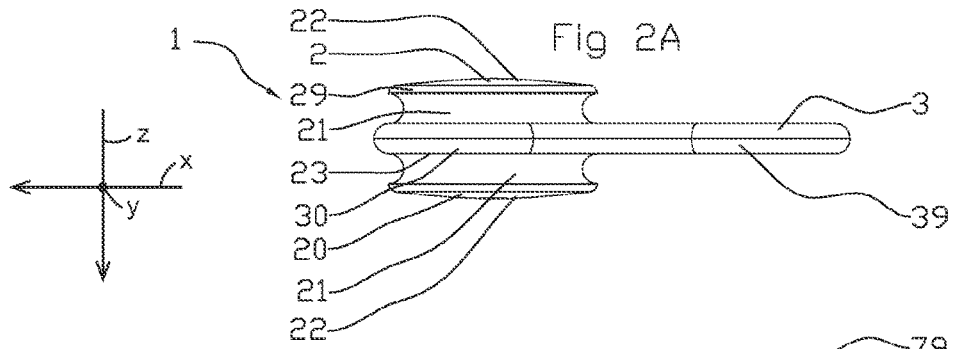
FIGS. 2A-C show the invention in a second embodiment; A: in a side view, B: in a perspective view and C: in an exploded view.
Figure 2B:
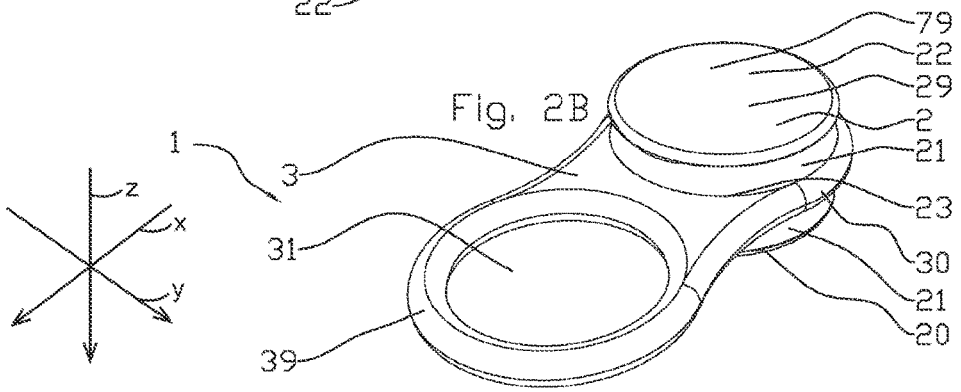

In the drawings, the reference number 1 indicates a connectable element according to the invention. The connectable element 1 is contoured relative to longitudinally extending x, laterally extending y and vertically extending z axes lying perpendicular to each other as seen in FIGS. 2A and 2B. The connectable element 1 comprises a center piece 2 and a connecting piece 3. At one end portion 30, the connecting piece 3 is attached to the center piece 2. The connecting piece 3 is provided with an eye 31 in a portion 39. The connecting piece 3 consists of an elastic material such as a natural rubber, a synthetic rubber or an elastomer. The elastomer may have a hardness of, for example, Shore A50 or Shore A70. The elastomer may be a thermoplastic elastomer. The thermoplastic elastomer may be a thermoplastic polyurethane. A suitable material may also be a thermosetting plastic. A suitable material may be a silicone rubber, a butyl rubber or a butadiene rubber. The eye 31 is formed in such a way that it can be threaded onto a center piece 2 of an adjacent connectable element 1. The center piece 2 may consist of a hard material. The hard material may be a plastic material, such as a thermoplastic. ABS plastic is an example of a suitable material. Polyethylene and polystyrene are examples of other suitable materials. In an alternative embodiment, the center piece 2 may consist of a natural material such as a wooden material or a metallic material. In a further alternative embodiment, the center piece 2 may consist of a resilient material.

The center piece 2 includes at least one encircling groove 21. The groove 21 is positioned at the side of the connecting piece 3 which is attached to the connecting portion 23 of the center piece 2.

The center piece 2 may comprise two parts, a lower half 20 and an upper half 29. At least one of the halves 20, 29 may include one or more projecting welding lugs 25. The welding lugs 25 are provided with welding surfaces 27 which, when the two halves 20, 29 are joined, lie in contact with the opposite half 20, 29. The two halves 20, 29 may be welded together by vibration welding as is known in the art.

The peripheral edge surfaces 26 of the welding lugs 25 form the connecting portion 23. In an alternative embodiment as shown in FIGS. 11, 12, the connecting portion 23 is formed of the inner edge surfaces 28 of the welding lugs 25.

Figure 2C:
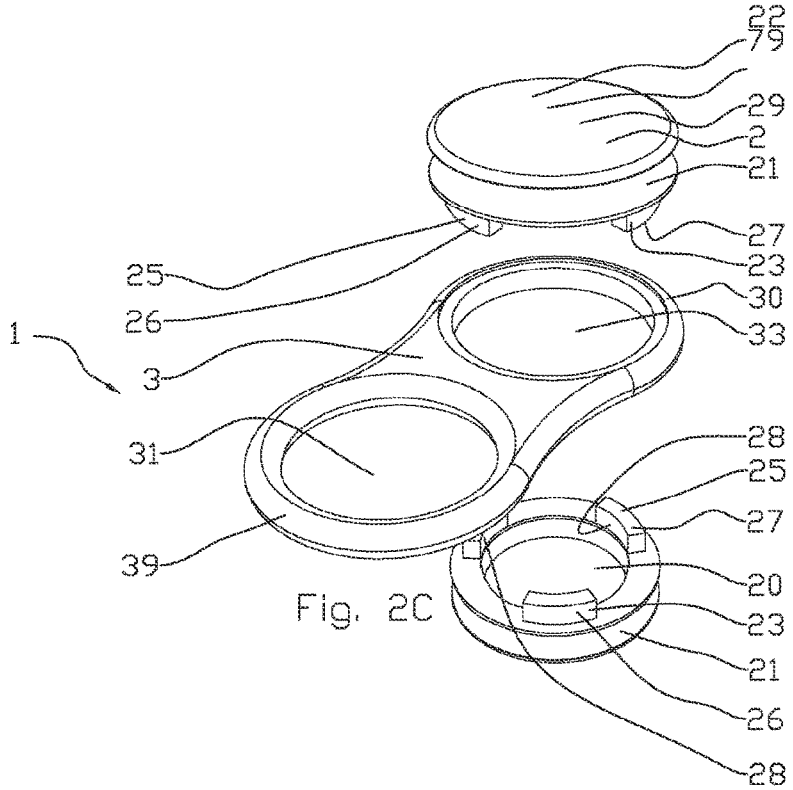
Figure 3A:
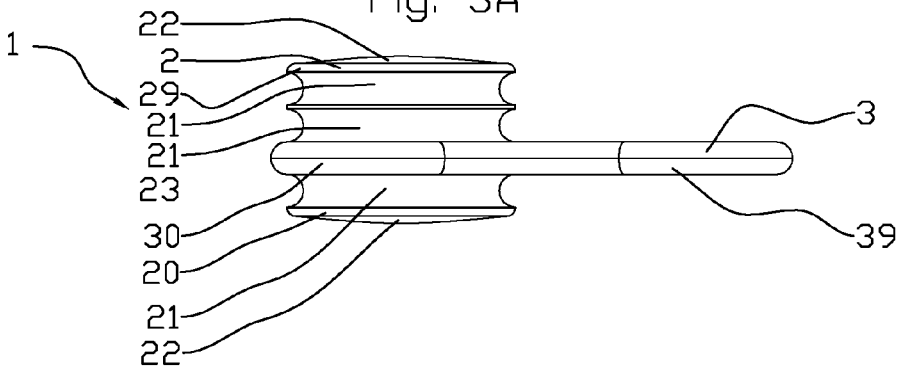
FIGS. 3A-C show the invention in a third embodiment; A: in a side view, B: in a perspective view and C: in an exploded view.
Figure 3B:
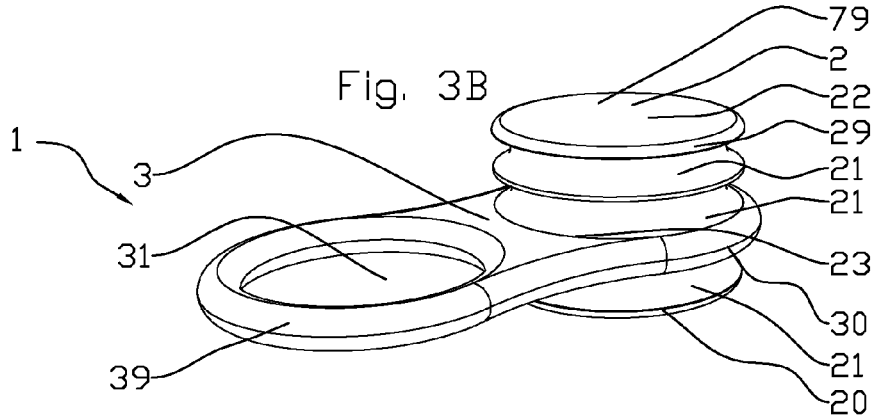
Figure 3B:
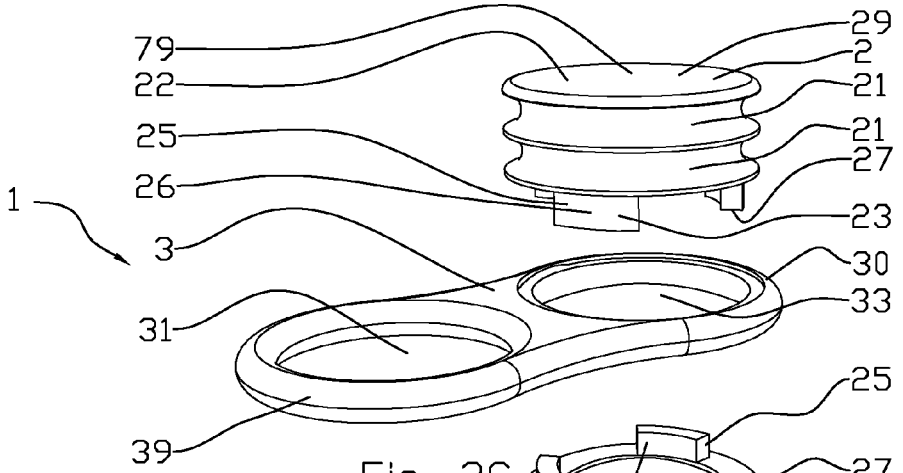
Figure 3C:
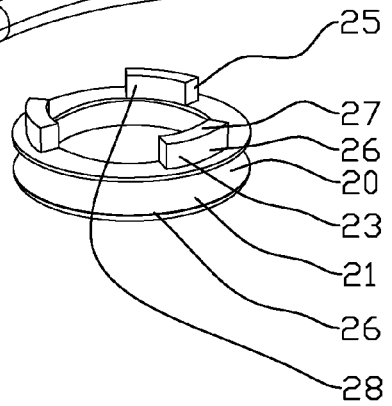

The center piece 2 may include a plurality of encircling grooves 21 as shown in FIGS. 2-4. The encircling grooves 21 may be positioned on both sides of the connecting portion 23.

In an end portion 30, the connecting piece 3 may be provided with an eye 33 that complementarily fits the connecting portion 23, so that the eye 33 encloses the center piece 2 as is shown in FIGS. 1-4. The eye 33 of the connecting piece 3 is positioned between the two halves 20, 29 before the halves 20, 29 are attached to each other, as shown in FIGS. 1D, 2C-4C. After the halves 20, 29 have been joined, the connecting piece 3 may be rotatably anchored to the center piece 2. By choosing suitable diameters for the connecting portion 23, the eye 33 and the end portions 22 of the halves 20, 29, and a suitable hardness for the material of the connecting piece 3, it may be very difficult to twist the connecting piece 3 out of the connecting portion 23.

In most of the figures, the center piece 2 is shown with a circular cross section, and the eye 33 is also shown as a circular through opening in the connecting piece 3. The invention is not limited to a circular geometry. An alternative embodiment is shown in FIG. 10. In this embodiment, the center piece 2 is formed with a hexagonal circumference. The encircling grooves 21 are also hexagonal, and the eye 33 is of a hexagonal shape. The center piece 2 may also be formed in other polygonal shapes (not shown), such as with a square circumference, a pentagonal circumference or an octagonal circumference. Correspondingly, the grooves 21 and the eye 33 may be formed with a square shape, a pentagonal shape or an octagonal shape. An elliptic shape is also possible.

In a further alternative embodiment, one end portion 22 or both end portions 22 of the center piece 2 may be formed with a polygonal shape, whereas the grooves 21, the connecting portion 23 and the eye 31 are formed with a circular shape, as shown in FIG. 13.

In an alternative embodiment, at least one half 20, 29 may include a pin 4 projecting upwards. The pin 4 projects up from the internal surface of one half 20, 29 in the direction of the other half 20, 29. The connecting piece 3 tapers in its end portion 30 so that the end portion 30 can be positioned inside the center piece 2, as shown in FIG. 11. A smaller eye 33' is formed in such a way that it complementarily fits the pin 4 and may be treaded onto the pin 4. The pin 4 is welded to the opposite half 20, 29. This embodiment has the advantage of the connecting piece 3 being fixedly anchored inside the center piece 2 and not being releasable from the center piece 2 without the center piece 2 or the connecting piece 3 being destroyed, which requires great force. Trials have shown that the connecting piece 3 first deforms, in order then to snap in the portion 39, rather than the connecting piece 3 snapping in the end portion 30.

In a further alternative embodiment, the connecting piece 3 may be provided with a thickening 35 as shown in FIG. 12. The connecting piece 3 tapers in its end portion 30, so that the end portion 30 may be positioned inside the center piece 2. The thickening 35 is formed in such a way that it complementarily fits an internal space formed by the inner edge surfaces 28 of the welding lugs 25 and the inner end faces of the halves 20, 29. This alternative embodiment also has the advantage of the connecting piece 3 being fixedly anchored inside the center piece 2 and not being releasable from the center piece 2 without the center piece 2 or the connecting piece 3 being destroyed, which requires great force.

Figure 8A:
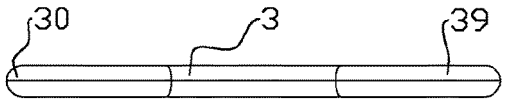
FIGS. 8A-C show the invention in a fifth embodiment; A: a side view of the connecting piece, B: a top view of the connecting piece and C: the invention in an exploded view.
Figure 8B:
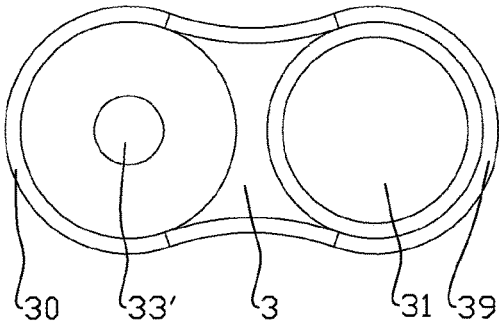
Figure 8C:
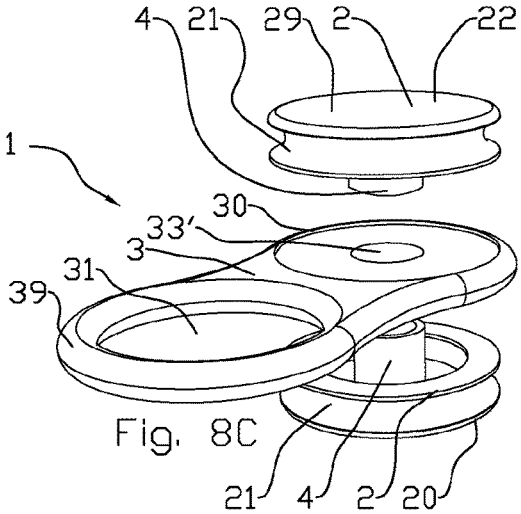

In a further alternative embodiment shown in FIG. 8, the end portion 30 of the connecting piece 3 may project beyond the periphery of the center piece 2 and the end portion 30 be provided with a smaller eye 33'. At least one of the halves 20, 29 is provided with a pin 4. In this embodiment, the halves 20, 29 are provided with welding lugs 25. The pin 4 is welded to the opposite half 20, 29. This embodiment also has the advantage of the connecting piece 3 being fixedly anchored inside the center piece 2 and not being releasable from the center piece 2 without the center piece 2 or the connecting piece 3 being destroyed, which requires great force. It may also be an advantage that the connecting piece 3 is rotatable around the axis of the center piece 2. It may also be an advantage that several assembled connectable elements 1 have a uniform appearance by the connecting piece 3 being visible over the entire circumference of the connecting portion 23, as is shown in FIGS. 1-7 as well.

Figure 9A:
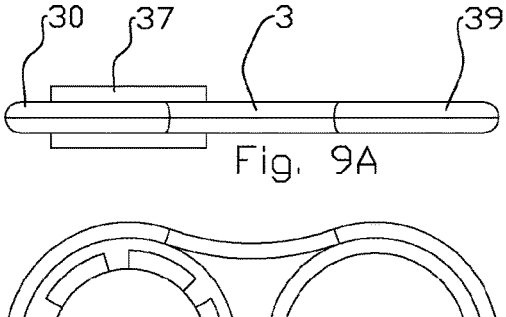
FIGS. 9A-C show the invention in a sixth embodiment; A: a side view of the connecting piece, B: a top view of the connecting piece and C: the invention in an exploded view.
Figure 9B:
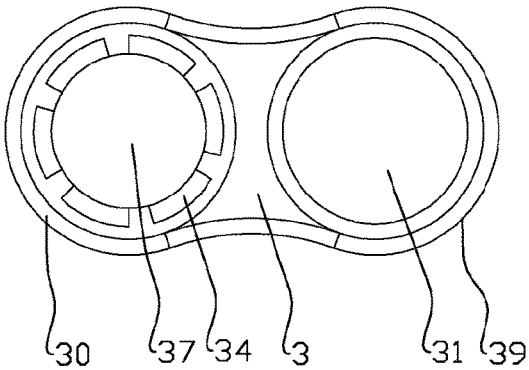
Figure 9C:
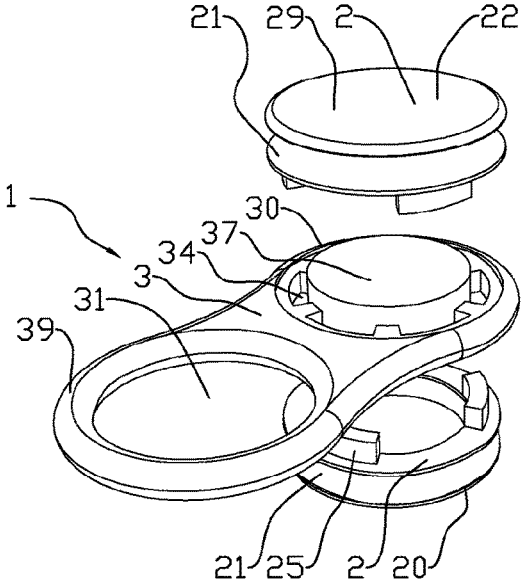
Figure 10A:
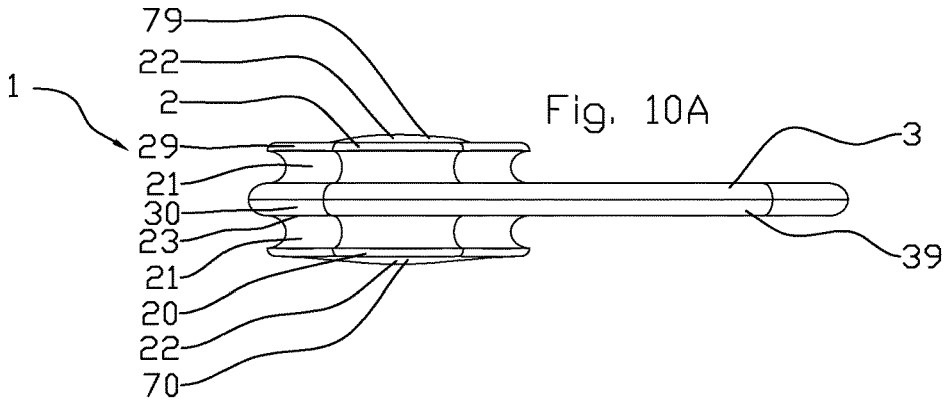
FIGS. 10A-D show the invention in a seventh embodiment; A: in a side view, B: in a top view of the connecting piece, C: in a perspective view and D: in an exploded view.
Figure 10B:
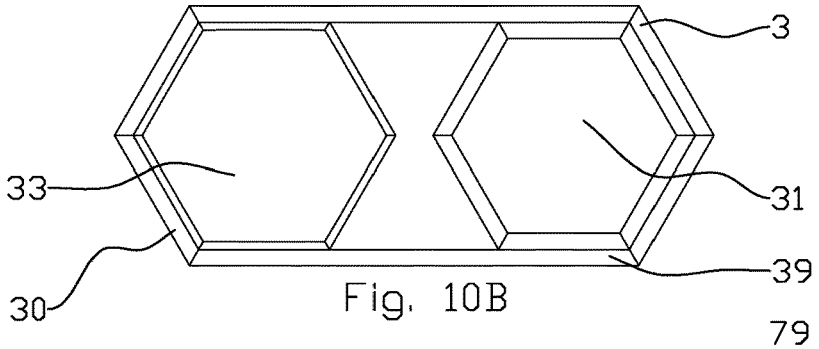
Figure 10C:
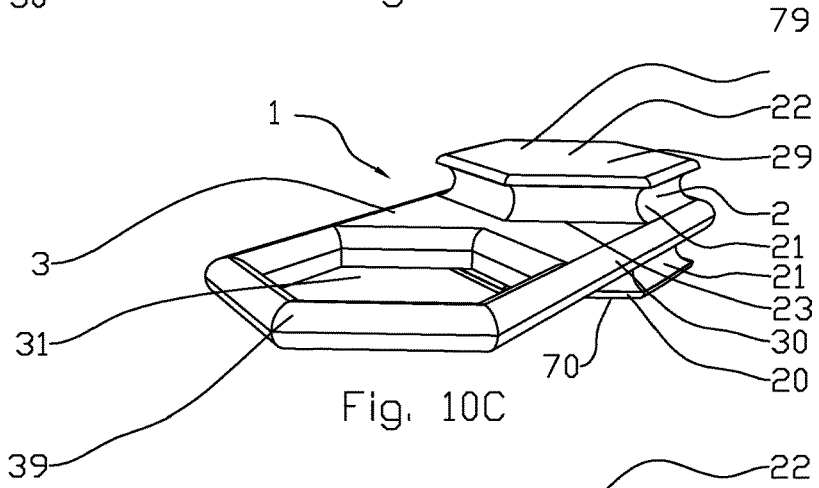
Figure 10D:
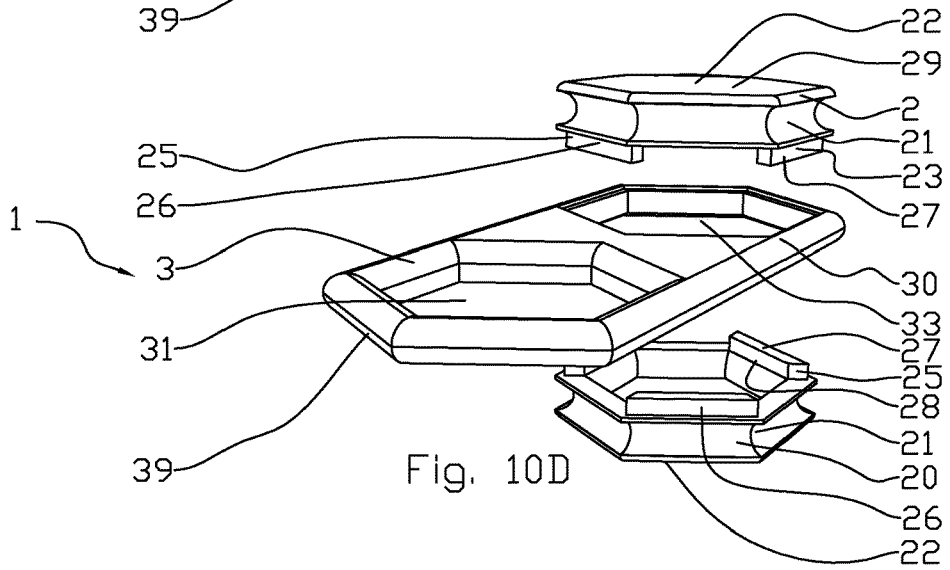
Figure 11A:
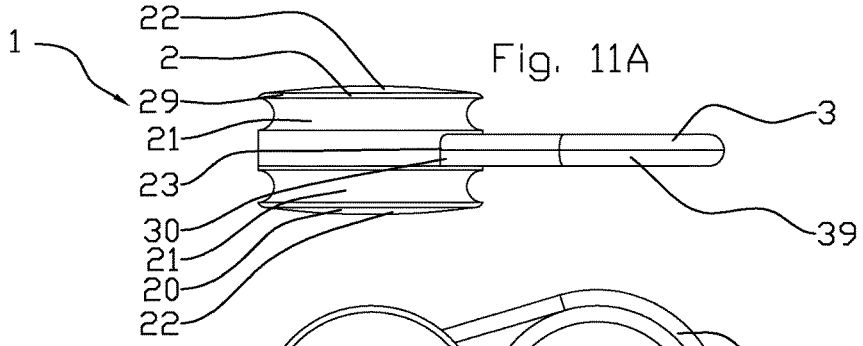
FIGS. 11A-D show the invention in an eighth embodiment; A: in a side view, B: in a top view, C: in a perspective view and D: in an exploded view.
Figure 11B:
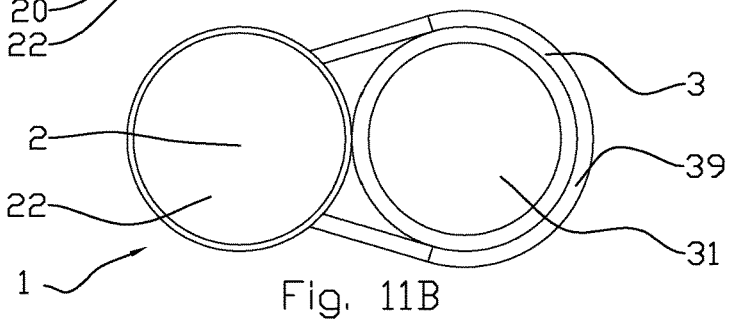
Figure 11C:
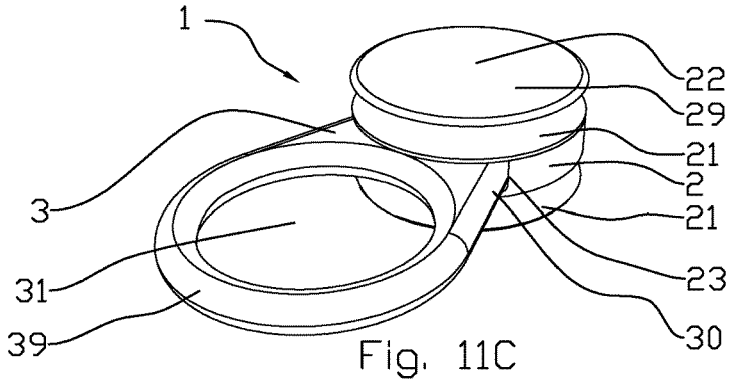
Figure 11D:
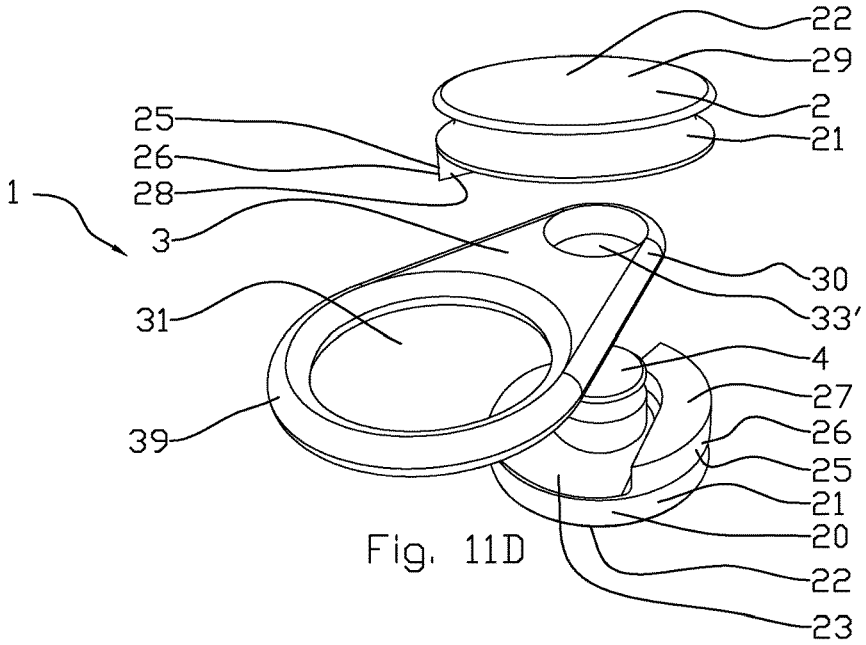

In a further alternative embodiment shown in FIG. 9, the end portion of the connecting piece 3 may project beyond the periphery of the center piece 2, and the end portion 30 may be provided with a thickening 37 and a through hole 34 encircling the thickening 37. The thickening 37 is positioned inside the center piece 2. The welding lugs 25 of the two halves 20, 29 are positioned in the holes 34 before the halves 20, 29 are joined together. This embodiment also has the advantage of the connecting piece 3 being fixedly anchored in the center piece 2 and not being releasable from the center piece 2 without the center piece 2 or the connecting piece 3 being destroyed, which requires great force. It may also be an advantage that several assembled connectable elements 1 have a uniform appearance by the connecting piece 3 being visible over the entire circumference of the connecting portion 23 as is also shown in FIGS. 1-7.

In an alternative embodiment, the connecting piece 3 is threaded loosely onto the center piece 2. In this embodiment, one encircling groove 21 of the center piece 2 constitutes the connecting portion 23. The center piece 2 may be solid or hollow.

Figure 5:
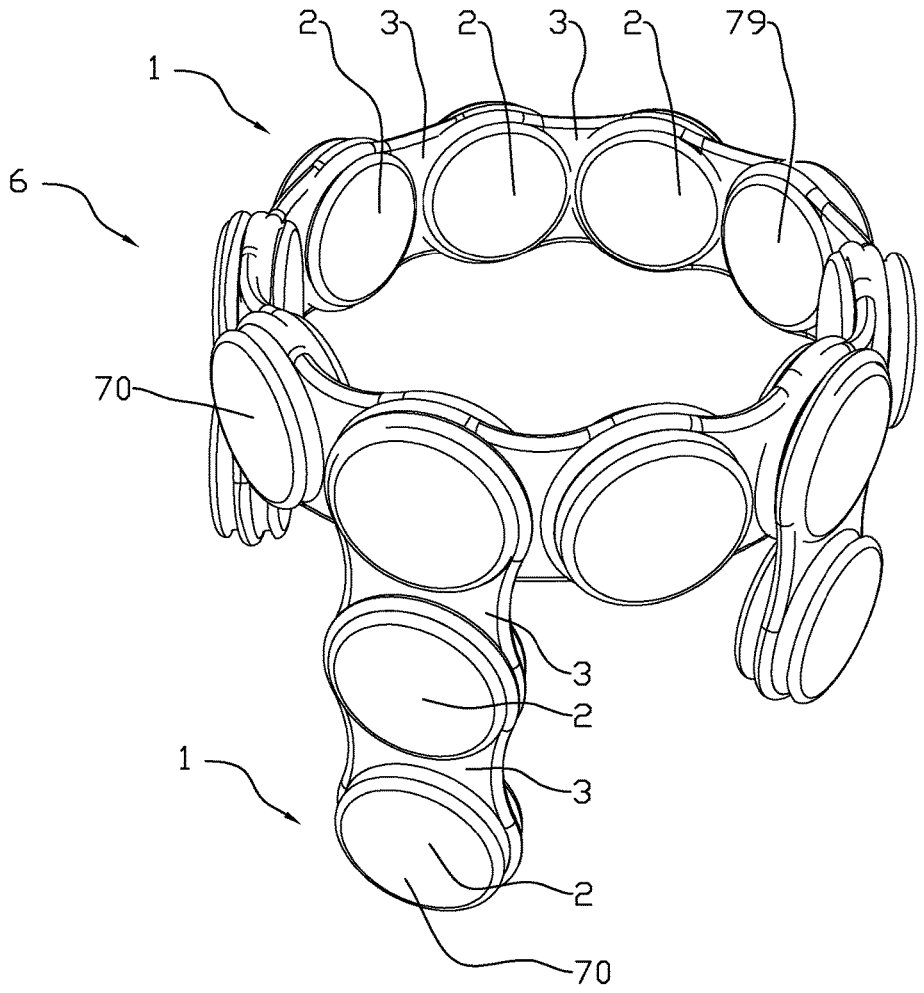
FIG. 5 shows a spatial assembly of connectable elements according to the invention, on a smaller scale.

The connecting piece 3 is formed from an elastic material so that the eye 31 can be threaded onto an adjacent center piece 2 and positioned in a groove 21. This may be repeated so that several connectable elements 1 are linked together. As the connecting piece 3 is flexible, a number of connectable elements 1 may be joined together into a ring 5, for example, as shown in FIG. 5. Each connectable element 1 may be provided with two or more grooves 21. This enables the connection of several connectable elements 1 in different directions from one connectable element 1. Spatial structures 6 may thereby be built from a number of connectable elements 1 as well, as shown in FIG. 5.

Figure 6A:
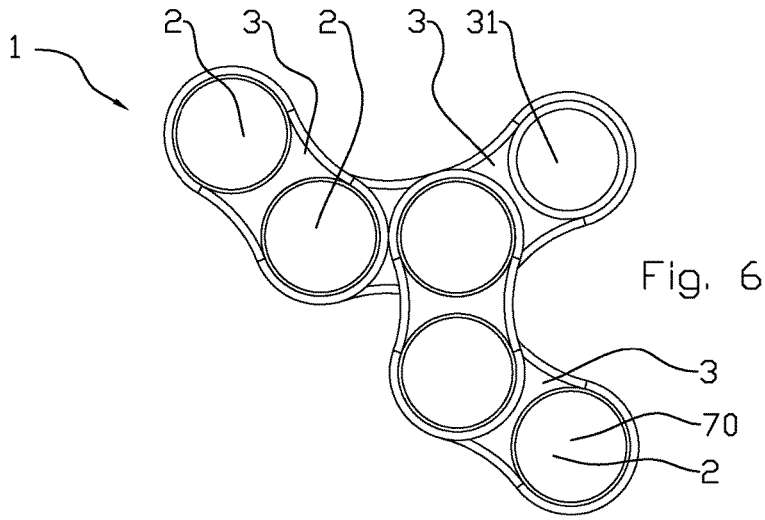
FIG. 6A-C shows an assembly of connectable elements according to the invention linked together, on another scale.
Figure 6B:
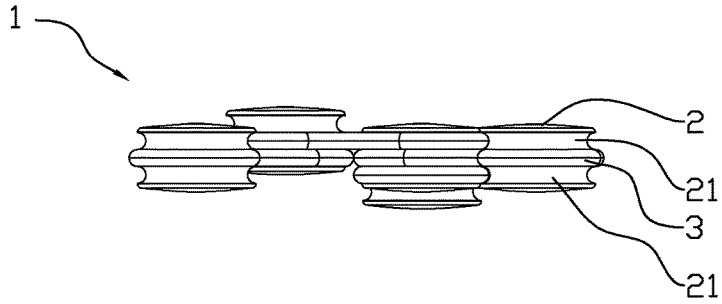
Figure 6C:
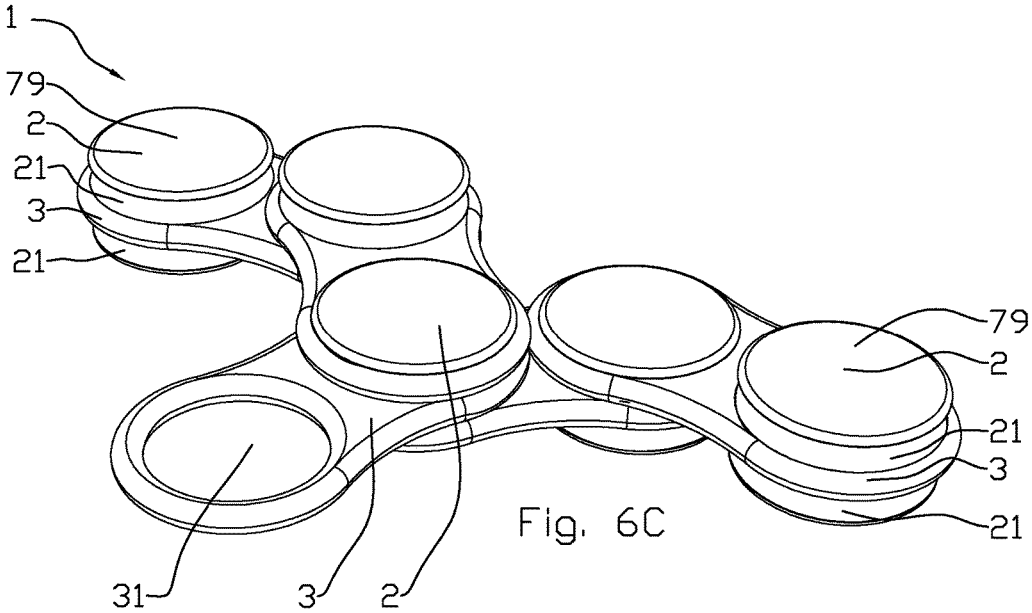
Figure 7A:
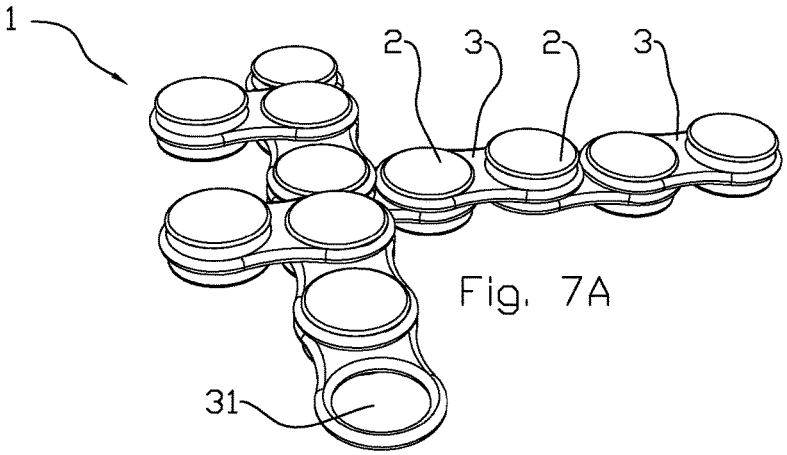
FIG. 7A-C shows an alternative assembly of connectable elements according to the invention linked together, on another scale.
Figure 7B:
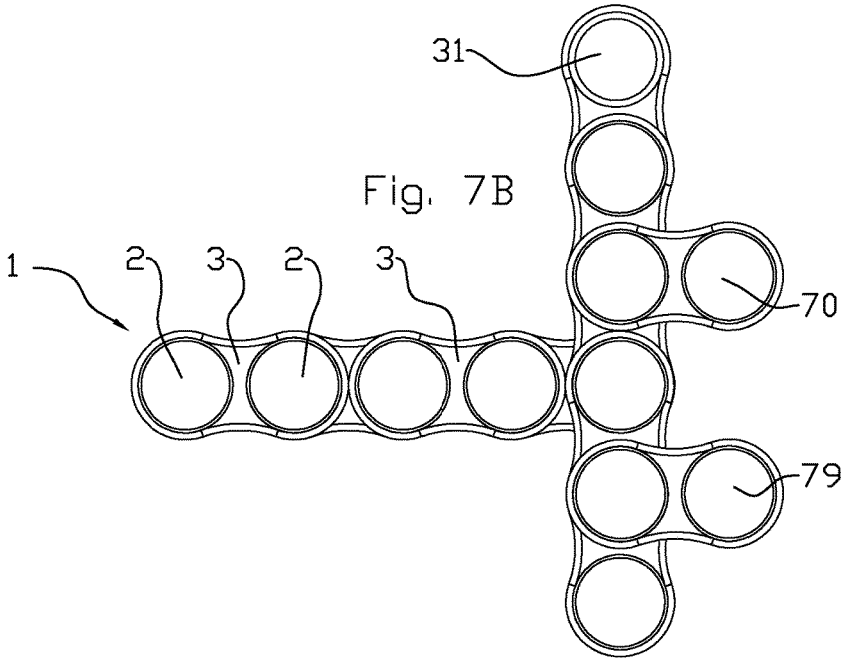
Figure 7C:
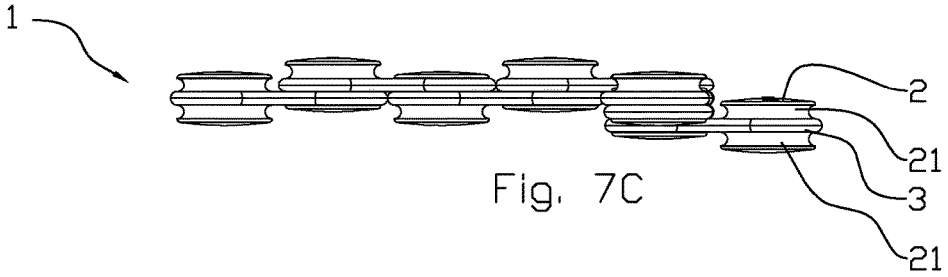

The connectable elements 1 may be connected at different angles as shown in FIG. 6. When the encircling groove 21 is circular and the eye 31 is circular, the connectable elements 1 may be connected to each other at any angle.

One end face 70 of the center piece 2 may be provided with information in the form of a letter, a numeric character, embossed printing, a symbol, a pictogram and the like. The center piece 2 may be provided with information on both end faces 70, 79. The information on one end face 70 may be different from the information on the other end face 79. The center piece 2 may be provided with a colour. Different center pieces 2 may be provided with different colours. The end faces 70, 79 may be provided with a colour. The colour of the end faces 70, 79 may differ from the colour of the center piece 2 in the grooves 21, and the colour of the end face 70 may differ from the colour of the end face 79.

The connectable element 1 may be used in a pedagogic connection. Several connectable elements 1 may be put together into words when the information of the end face 70, 79 is a letter. Such connectable elements 1 with a letter may also be used to create a crossword as shown schematically in FIG. 7. To a connectable element 1 provided with three groves 21, connectable elements 1 may be connected in four directions. A side chain may be formed anywhere on an established chain by a new connectable element 1 being threaded with its connecting piece 3 onto an unoccupied groove 21 in a center piece 2 of the established chain. A number of connectable elements 1 may be joined into a bracelet showing a name.

The connectable element 1 may also be used in mathematics teaching when the end faces 70, 79 are provided with numeric characters and mathematical symbols.

Joining the two halves 20, 29 may be done in several ways as is known within the art. The halves 20, 29 may be glued together. The halves 20, 29 may be provided with projecting hooks that engage with latch grooves in the opposite half 20, 29 (not shown).

The invention claimed is:

1. A connectable element comprising a center piece and a connecting piece wherein the center piece includes a connecting portion and at least two concentric encircling grooves lying outside the connecting portion; and the connecting piece includes an end portion and an eye in a portion;

the end portion of the connecting piece being attached to the connecting portion of the center piece such that the center piece with the at least two concentric, encircling grooves projects perpendicularly and coaxially above and below the connecting piece; and the eye complementarily fitting one encircling groove of an adjacent center piece.

2. The connectable element according to claim 1, wherein the connecting piece comprises an elastic material.

3. The connectable element according to claim 1, wherein the end portion of the connecting piece is attached internally in the center piece.

4. The connectable element according to claim 3, wherein the center piece is provided with a pin internally, and wherein the end portion of the connecting piece is provided with an eye which is complementary to the pin within the center piece.

5. The connectable element according to claim 3, wherein the end portion of the connecting piece is provided with a thickening which fits internally in the center piece.

6. The connectable element according to claim 1, wherein the end portion of the connecting piece is provided with an eye surrounding the connecting portion of the center piece.

7. The connectable element according to claim 1, wherein the center piece comprises a lower half and an upper half, and at least one of the halves is formed with at least one projecting element for joining the two halves together.

8. The connectable element according to claim 1, wherein the center piece includes at least one encircling groove on each upper and lower side of the connecting portion.

9. The connectable element according to claim 1, wherein the encircling groove is of a circular shape.

10. The connectable element according to claim 1, wherein an end portion of the center piece is of a full circular shape.

11. The connectable element according to claim 1, wherein an end portion of the center piece is formed as a polygon.

12. The connectable element according to claim 1, wherein an end portion of the center piece includes an end face and the end face is provided with information.

13. The connectable element according to claim 1, wherein the at least two concentric encircling grooves are located externally of the center piece.

14. The connectable element according to claim 1, wherein the connecting portion is located within the center piece.

15. A connectable element comprising a center piece and a connecting piece wherein the center piece includes a connecting portion and at least two concentric encircling grooves lying outside the connecting portion; and the connecting piece includes an end portion and an eye in a portion;

the end portion of the connecting piece being attached to the connecting portion of the center piece such that the center piece with the at least two concentric, encircling grooves projects coaxially above and below the connecting piece; and the eye complementarily fitting one encircling groove of an adjacent center piece.

16. The connectable element according to claim 1, wherein the connecting portion is located between the at least two concentric encircling grooves.

17. The connectable element according to claim 15, wherein the connecting portion is located between the at least two concentric encircling grooves.

18. A connectable element contoured relative to longitudinally extending x, laterally extending y and vertically extending z axes lying perpendicular to each other, the connectable element comprising:

a center piece and a connecting piece joined together;

wherein the center piece includes a connecting portion extending in a direction along the z axis and enclosed within the center piece, and at least two concentric encircling grooves lying outside the connecting portion;

wherein the connecting piece lies between the at least two concentric encircling grooves and includes one end portion and an eye in another end portion;

the one end portion of the connecting piece being attached to the connecting portion of the center piece such that the center piece with the at least two concentric encircling grooves projects coaxially above and below the connecting piece in a direction along the z axis, the eye complementarily fitting one encircling groove of an adjacent center piece; and wherein, when viewed in an xz plane defined by the x and z axes, the at least two concentric encircling grooves are visible externally of the connecting piece.

* * * * *